US006688198B2

(12) United States Patent
Matsumoto et al.

(10) Patent No.: US 6,688,198 B2
(45) Date of Patent: Feb. 10, 2004

(54) APPARATUS FOR CUTTING A SHEET-SHAPED MATERIAL

(75) Inventors: Kazuyuki Matsumoto, Tokyo-to (JP); Yoshinobu Sakemi, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 21 days.

(21) Appl. No.: 09/961,959

(22) Filed: Sep. 24, 2001

(65) Prior Publication Data

US 2002/0050200 A1 May 2, 2002

(30) Foreign Application Priority Data

Nov. 2, 2000 (JP) ..... P2000-336543

(51) Int. Cl.[7] ..... B26D 7/02

(52) U.S. Cl. ..... 83/139; 83/51; 83/452; 83/456; 83/679

(58) Field of Search ..... 83/452, 456, 679, 83/650, 51, 139, 225, 140

(56) References Cited

U.S. PATENT DOCUMENTS

| | | | | | |
|---|---|---|---|---|---|
| 2,013,679 | A | * | 9/1935 | Altvater | 83/468.94 |
| 2,364,835 | A | * | 12/1944 | Whistler et al. | 83/140 |
| 2,976,754 | A | * | 3/1961 | Wennes | 83/139 |
| 3,167,985 | A | * | 2/1965 | Madsen | 83/139 |
| 3,256,419 | A | * | 6/1966 | Taylor et al. | 219/83 |
| 3,316,790 | A | * | 5/1967 | Frederiksen | 83/679 |
| 3,492,853 | A | * | 2/1970 | Gross | 72/203 |
| 3,871,254 | A | * | 3/1975 | Whistler et al. | 83/139 |
| 4,826,561 | A | * | 5/1989 | Carroll | 83/140 |
| 4,856,393 | A | * | 8/1989 | Braddon | 83/50 |
| 5,394,778 | A | * | 3/1995 | Sakowski | 83/106 |
| 6,401,510 | B1 | * | 6/2002 | Morse et al. | 72/327 |
| 6,475,878 | B1 | * | 11/2002 | Slepcevic | 438/460 |

FOREIGN PATENT DOCUMENTS

JP 11300687 11/1999

* cited by examiner

*Primary Examiner*—Allan N. Shoap
*Assistant Examiner*—John Windmuller
(74) *Attorney, Agent, or Firm*—Ladas & Parry

(57) ABSTRACT

An apparatus for cutting a sheet-shaped material, comprises the first blade, the second blade, the first holding members and the second holding members. The second blade is disposed to face the first blade so that a sheet-shaped material to be cut is placed between the first blade and the second blade. The first holding members are disposed on the opposite sides of the first blade, respectively. Each of the first holding members has a cushioning property by which each of the first holding members is elastically deformed to press the sheet-shaped material during cutting operation. The second holding members are disposed on the opposite sides of the second blade, respectively. Each of the second holding members has a cushioning property by which each of the second holding members is elastically deformed to hold the sheet-shaped material during cutting operation. The first holding members and the second holding members hold the sheet-shaped material from the opposite surfaces thereof when cutting the sheet-shaped material by means of the first and second blades.

19 Claims, 13 Drawing Sheets

APPARATUS FOR CUTTING A SHEET-SHAPED MATERIAL

BACKGROUND OF THE INVENTION

1. Field of the Invention

The present invention relates to an apparatus for cutting a sheet-shaped material, which permits it to accurately and smoothly cut a sheet-shaped material formed of synthetic resin or the like.

2. Description of the Related Art

Various sheet-shaped materials such as Fresnel lens sheets, lenticular lens sheets or the like can be manufactured in accordance with a method as illustrated in FIGS. 7 and 8.

FIGS. 7 and 8 illustrate an example of a method for manufacturing a Fresnel lens sheet. First, a forming die 1 for the Fresnel lens is prepared and ultraviolet ray curing type resin 2 in the form of a liquid is dripped on a side of the forming die 1 (see FIG. 7(A)). Then, a substrate sheet 3 formed of a rigid synthetic resin is placed on the forming die 1. The substrate sheet 3 and the forming die 1 with the dripped resin are supplied into a space between a pair of nip rollers 4 (see FIG. 7(B)). A pressing operation, which is applied to the forming die 1 and the substrate sheet 3 by the nip rollers 4, causes the liquid ultraviolet ray curing type resin to flow and spread between the forming die 1 and the substrate 3. The ultraviolet ray curing type resin 2 is supplied in a relatively large amount so as to spread all over recess portions of the forming die 1. A superfluous amount of resin 2*a* flows out of the forming die 1 to reach the outside of the four peripheral sides thereof when carrying out a pressing operation by means of the nip rollers 4. A receiving member 1*a* for receiving the superfluous amount of resin 2*a* is provided on the four peripheral sides of the forming die 1 to project outside therefrom. The forming die 1, which has passed the nip rollers 4, is subjected to radiation of ultraviolet rays from above the substrate sheet 3 to cure the ultraviolet ray curing type resin 2. After curing is complete, the substrate, onto which the ultraviolet ray curing type resin 2 adheres, is removed from the forming die 1, thus preparing a sheet 5 of Fresnel lens as a semi-finished product (see FIGS. 7(C) and 8(A)).

The thus prepared sheet 5 of Fresnel lens as the semi-finished product has a larger size than the prescribed size of the Fresnel lens sheet to be used as the finished product and is provided with unwanted portions onto which the superfluous amount of resin 2*a* adheres. Accordingly, the sheet 5 is cut along the four cutting lines CL1, CL2, CL3 and CL4 as shown in FIG. 8(A). As a result, there is obtained a square or rectangular sheet 6 of Fresnel lens having the prescribed size as shown in FIG. 8(B).

It is necessary to cut the sheet 5 of Fresnel lens as the semi-finished product along the four cutting lines to remove the unwanted portions from the sheet 5 as described above. A conventional apparatus for cutting a sheet-shaped material, which is disclosed in Japanese Laid-Open Patent Application No. H11-300687, has been used to prevent cracks from occurring on the finished product side and burrs from occurring on the cutting surface when carrying out the above-mentioned cutting operation.

The conventional apparatus for cutting a sheet-shaped material is provided with a pair of blades, i.e., upper and lower blades, and holding members. The upper and lower blades face each other in the vertical direction so that the sheet-shaped material 5 of the semi-finished product is supplied horizontally and placed between the upper and lower blades. The holding members, which are made of material having a cushioning property, are disposed on the opposite sides of the lower blade. The holding members come into contact with the sheet-shaped material 5 when cutting it by means of the upper and lower blades. When the cutting operation starts to cut the sheet-shaped material 5, the upper blade comes into contact with the sheet-shaped material 5, prior to contact of the lower blade with the sheet-shaped material 5, so as to urge the sheet-shaped material on the holding members to be resiliently bent, and then, the lower blade comes into contact with the sheet-shaped material 5 thus bent.

However, in the conventional apparatus for cutting a sheet-shaped material, a superfluous amount of resin 2*a*, adhering on the sheet-shaped material as the semi-finished product, exerts an adverse influence during the cutting operation, causing the occurrence of cracks on the finished product side and burrs on the cutting surface, decreasing the cutting depth of the conventional apparatus tends to ease the occurrence of the above-mentioned cracks and burrs.

SUMMARY OF THE INVENTION

An object of the present invention is to provide an apparatus for cutting a sheet-shaped material, which makes it possible to accurately cut the sheet-shaped material without the occurrence of cracks on the finished product side and burrs on the cutting surface of the finished product.

In order to attain the aforementioned object, the apparatus of the first aspect of the present invention comprises: a first blade; a second blade disposed to face said first blade so that a sheet-shaped material to be cut is placed between said first blade and said second blade; first holding members disposed on opposite sides of said first blade, each of said first holding members being formed of self-deformable material so as to be elastically deformable by pressing said sheet-shaped material during the cutting operation; and second holding members disposed on opposite sides of said second blade, each of said second holding members being formed of self-deformable material so as to be elastically deformable to hold said sheet-shaped material during the cutting operation, said first holding members and said second holding members holding said sheet-shaped material from opposite surfaces thereof when cutting said sheet-shaped material by means of said first and second blades. It is therefore possible to prevent cracks from occurring on portions other than the cutting surface, and burrs from occurring on the cutting surface.

In accordance with the second aspect of the present invention, there may be adopted a structure in which each of said first blade and said second blade has a primary face and a secondary face, the primary face of said first blade being substantially aligned with the primary face of said second blade, and the secondary faces of said first blade and said second blade being directed to opposite directions to each other. With such a structure it is possible to prevent an excessively large stress from occurring on the sheet-shaped material even when the first and second blades come into contact with a cured portion of superfluous resin. As a result, the occurrence of cracks on the finished product side can be prevented.

In accordance with the third aspect of the present invention, there may be adopted a structure in which blade edges of the first and second blades do not come into contact with each other to form a gap between said blade edges when the first and second blades are in a closest proximity to each other. According to such a structure, it is possible to form notches on the opposite surfaces of the sheet-shaped material by means of the first and second blades during the first half of the single cutting process and then to break the portion of the sheet-shaped material, which corresponds to the above-mentioned gap between the blade edges, during the second half thereof. It is therefore possible to easily cut the sheet-shaped material including the substrate sheet formed of hard material.

In accordance with the fourth aspect of the present invention, there may be adopted a structure in which said second holding members comprise a front-side holding member, which is to be brought into contact with a finished product side of the sheet-shaped material and a rear-side holding member, which is to be brought into contact with a useless end portion side of the sheet-shaped material, said rear-side holding member having a smaller thickness than said front-side holding member in a non-deformed state. Such a structure provides a smooth shearing action by means of the first and second blades. The entire holding force by which the sheet-shaped material 5 is held d uring the cutting operation, is reduced, thus making it possible to prevent the sheet-shaped material from whitening.

In accordance with the fifth aspect of the present invention, there may be adopted a structure in which said first holding members comprise a front-side holding member, which is brought into contact with a finished product side of the sheet-shaped material and a rear-side holding member, which is brought into contact with a useless end portion side of the sheet-shaped material, and said rear side holding member has a laminate structure having a lower layer and an upper layer, said lower layer being formed of a higher hardness than said upper layer. Such a structure provides a smooth shearing action by means of the first and second blades.

In accordance with the sixth aspect of the present invention, the apparatus may further comprise displacement prevention members to prevent the holding members, which come into contact with the sheet-shaped material when cutting the sheet-shaped material by means of the first and second blades, from being displaced in a traveling direction of the sheet-shaped material. With these additional features, it is possible to prevent cracks from occurring on the finished product side.

In accordance with the sixth aspect of the present invention, the apparatus may further comprise a supply unit for supplying alternately the sheet-shaped materials from a plurality of supply sources to the first and second blades. With this additional feature, it is possible to reduce the period of time required to supply the sheet-shaped materials to the first and second blades in comparison with the case where the single sheet-shaped material is supplied from the single supply source to the cutting unit, thus improving the cutting efficiency.

BRIEF DESCRIPTION OF THE DRAWINGS

FIG. 7(A) illustrates a forming die on which ultraviolet ray curing type resin is applied, FIG. 7(B) illustrates the forming die and a substrate sheet, which are subjected to a pressing process and FIG. 7(C) illustrates a sheet-shaped material formed as the semi-finished product.

DETAILED DESCRIPTION OF THE PREFERRED EMBODIMENTS

Now, embodiments of the present invention will be described in detail below with reference to the accompanying drawings.

Figure 1:
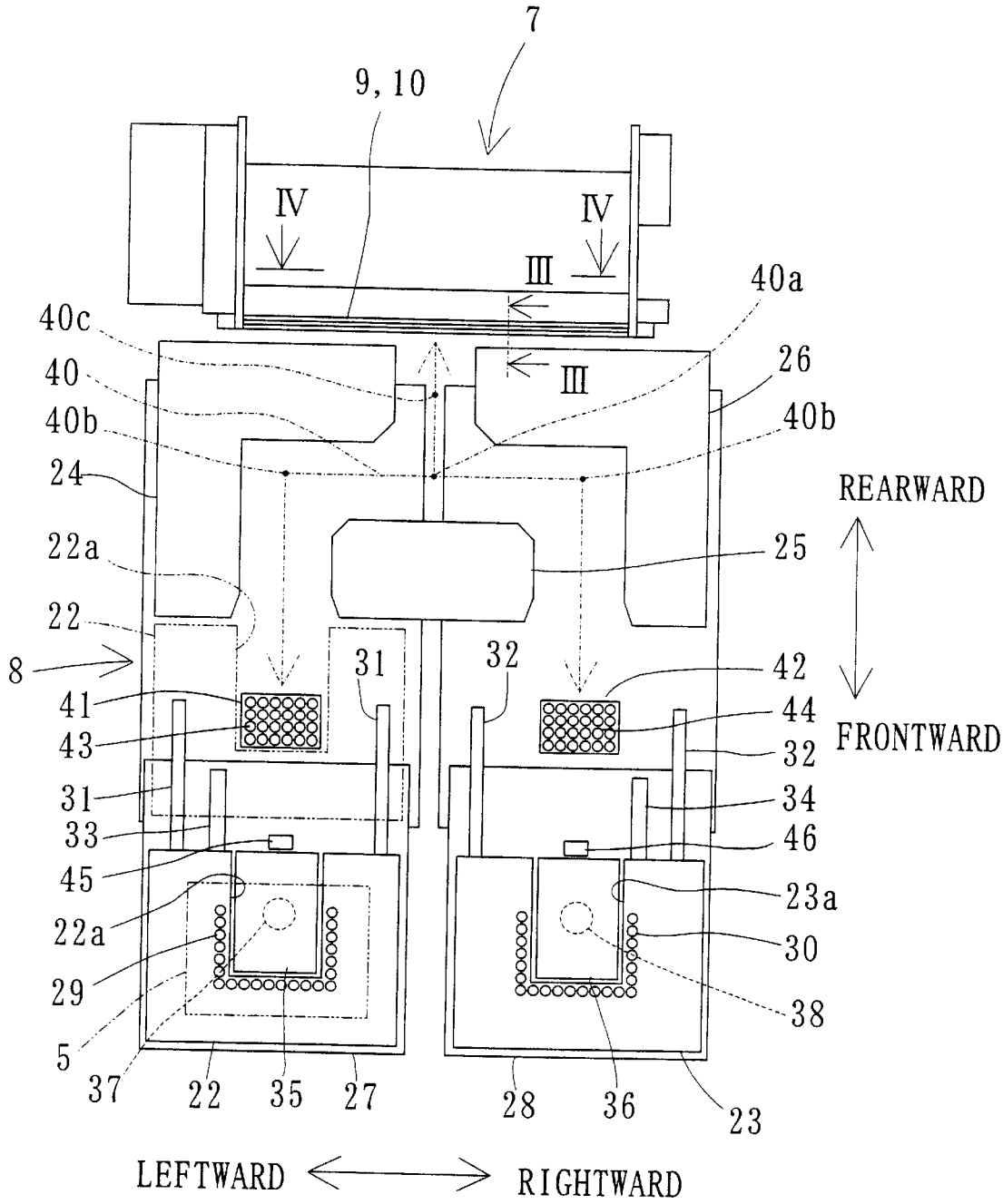
FIG. 1 is a plan view of an apparatus of the present invention for cutting a sheet-shaped material.
Figure 2:
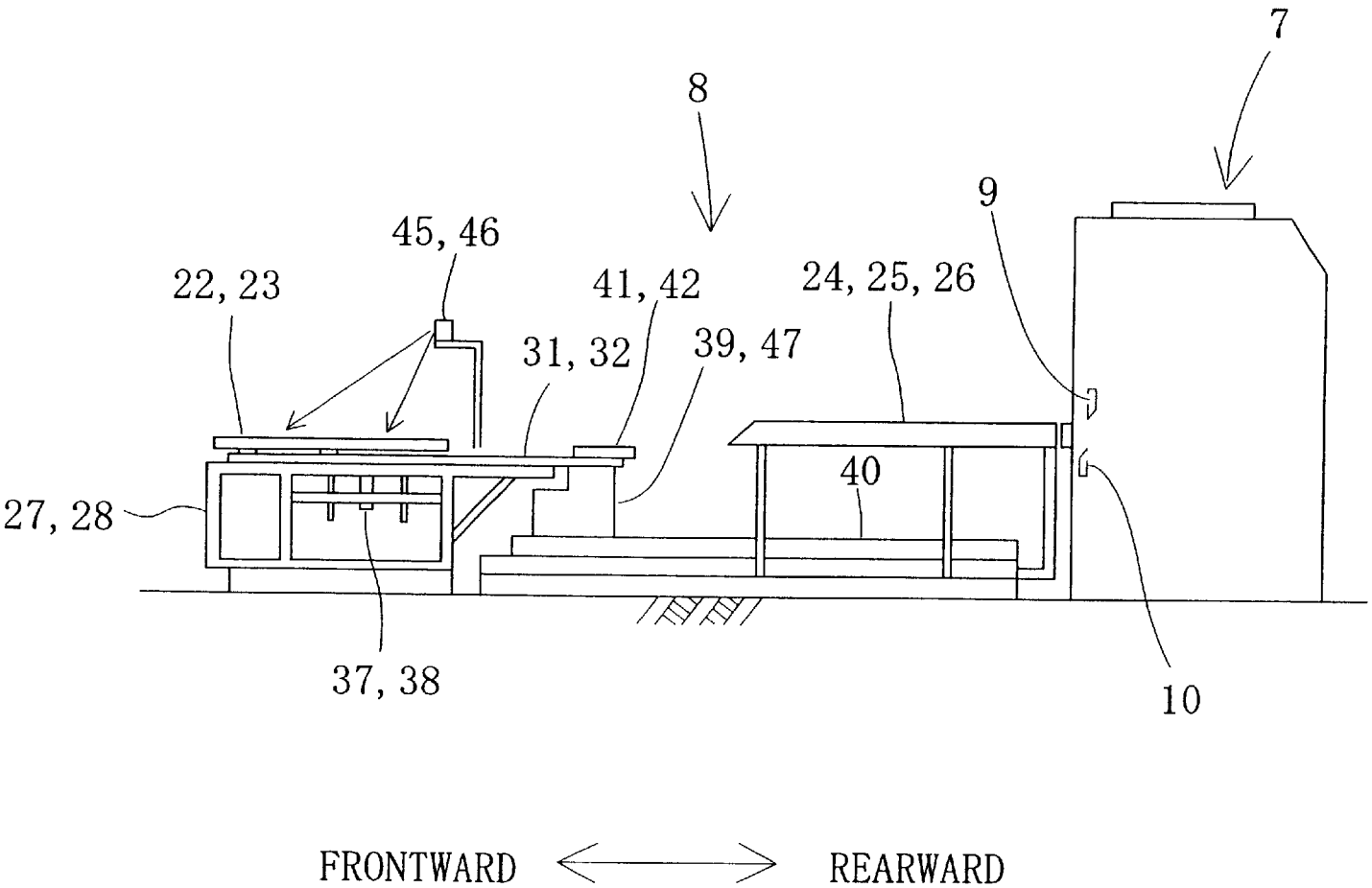
FIG. 2 is a right-hand side view of the apparatus of the present invention for cutting the sheet-shaped material.

As shown in FIGS. 1 and 2, an apparatus of the present invention for cutting a sheet-shaped material has a cutting unit 7 and a supply unit 8 for supplying a sheet-shaped material 5 as the semi-finished product into the cutting unit 7. The cutting unit 7 is disposed on the rear side in the cutting apparatus and the supply unit 8 is disposed on the front side therein.

Figure 3:
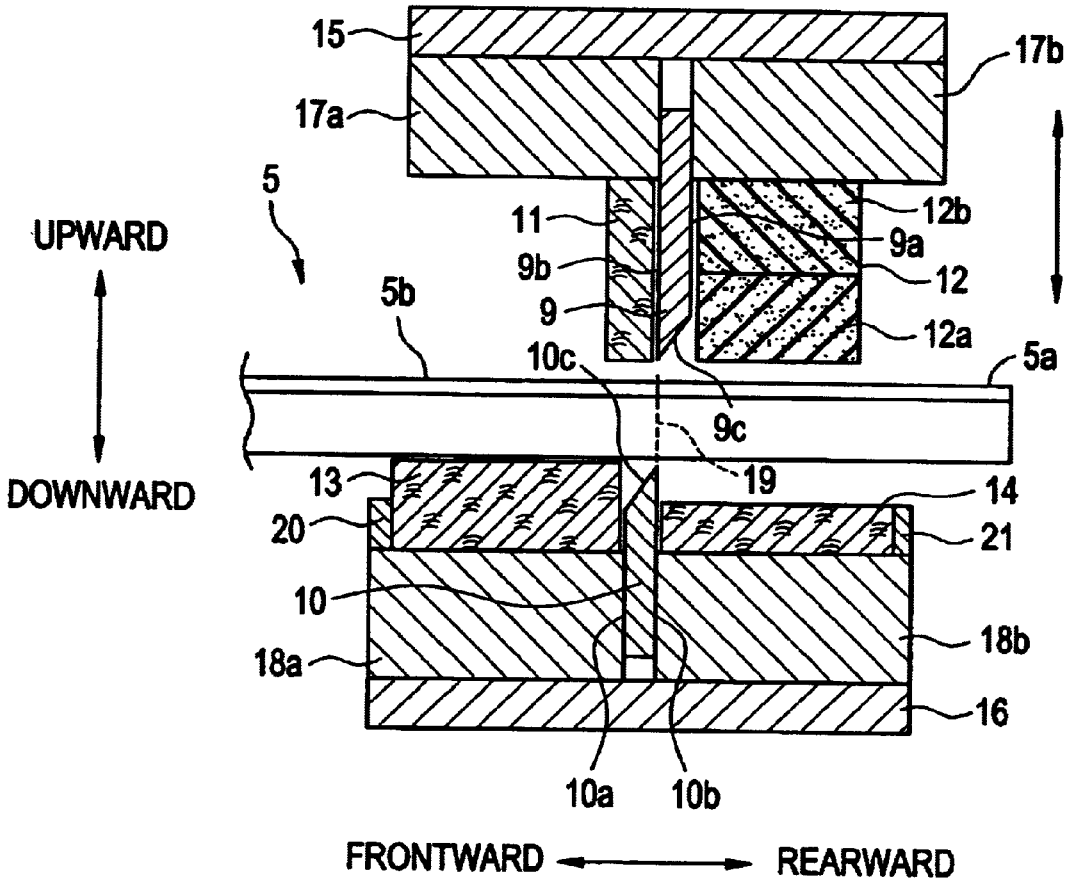
FIG. 3 is a cross-sectional view cut along the III—III line in FIG. 1.
Figure 4:
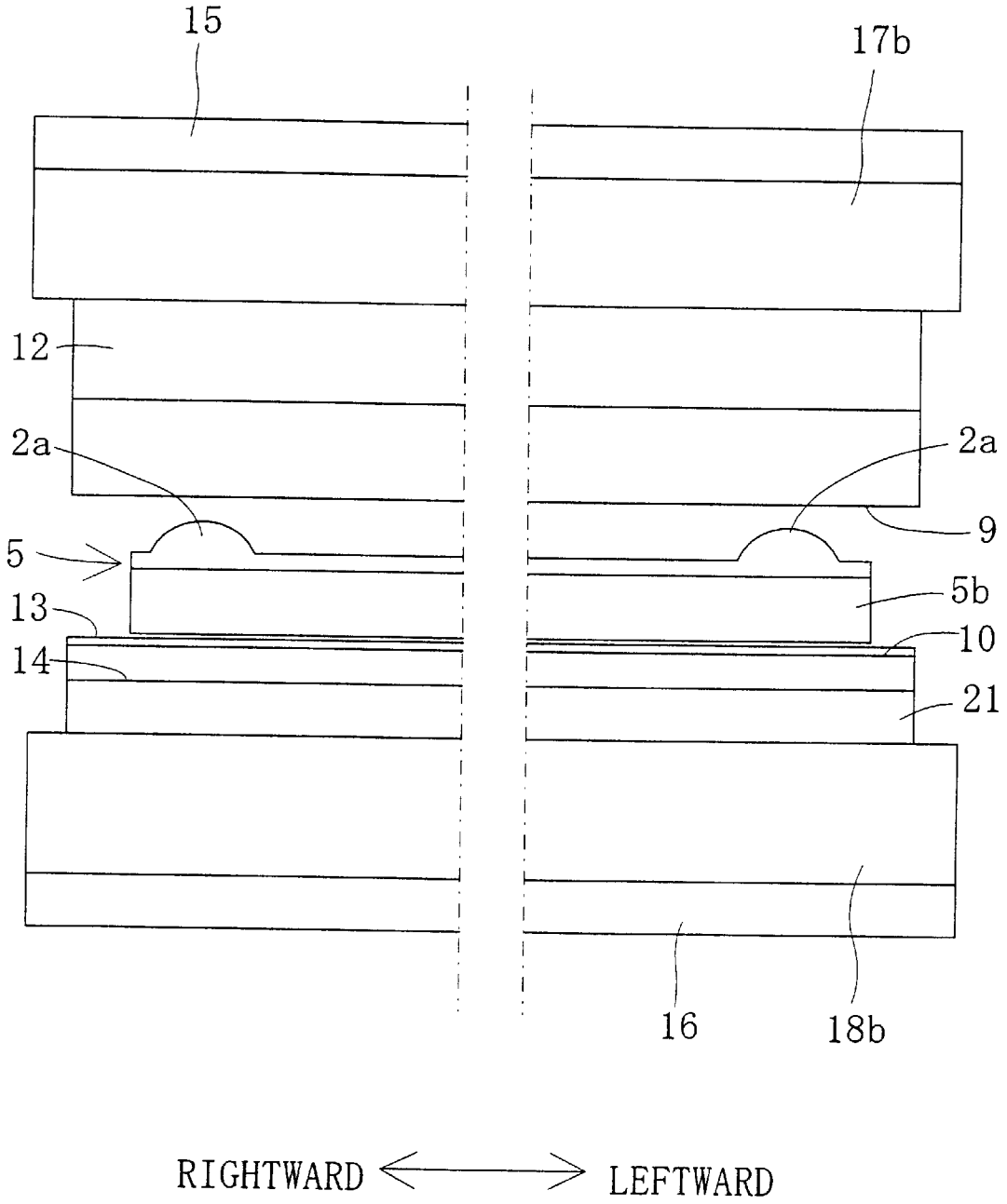
FIG. 4 is a view having a viewing direction based on the IV—IV line in FIG. 1.

The cutting unit 7 has a pair of blades, i.e., the first and second blades 9 and 10, and holding members 11,12,13 and 14 having a cushioning property, as shown in FIGS. 3 and 4. The first and second blades 9 and 10 face each other in the vertical direction so that the sheet-shaped material 5 to be cut, which is supplied horizontally, is placed between the first (i.e., upper) blade 9 and the second (i.e., lower) blade 10. The holding members may be classified into first holding members 11 and 12, which are disposed on the opposite sides of the upper blade 9, respectively, and second holding members 13 and 14, which are disposed on the opposite sides of the lower blade 10, respectively.

The upper and lower blades 9 and 10 extend transversely across the cutting unit 7. The upper blade 9 is clamped between upper clamping members 17*a* and 17*b*, which are secured on an upper base member 15. The lower blade is clamped between lower clamping members 18*a* and 18*b*, which are secured on a lower base member 16. There is carried out a positional adjustment of the upper and lower blades 9 and 10 relative to the upper and lower base members 15 and 16 by means of the clamping members 17*a*, 17*b*, 18*a* and 18*b*, and then, the upper and lower blades 9 and 10 are stationarily held on the upper and lower base members 15 and 16. The lower base member 16 is fixed on a frame of the cutting unit 7 together with the lower blade 10. The upper base member 15 is supported on the frame of the cutting unit 7 so as to be movable in the vertical direction together with the upper blade 9. The pair of blades 9 and 10 may be placed to extend horizontally and the sheet-shaped material may be supplied vertically. Any one of the blades 9 and 10 may be movable or both blades may be movable. As shown in FIG. 3, when the cutting operation starts, the sheet-shaped material 5 is inserted between the upper and lower blades 9 and 10 form the front side toward the rear side. It moves to a prescribed position and then stays still. A single reciprocating motion of the upper blade 9 causes a useless end portion 5*a* to be cut from a product 5*b* side. In the embodiment as shown in the drawings, the sheet-shaped material 5 is supplied so that the surface of the formed body, such as a lens made of ultraviolet ray curing type resin 2 or the like, is directed to the upper blade 9. The sheet-shaped material 5 may be supplied so that the surface of the formed body is directed to the lower blade 10.

As shown in FIG. 3, the edges of the upper and lower blades 9 and 10 have slant faces 9*c* and 10*c*, respectively, which connect primary faces 9*b* and 10*b* with secondary faces 9*a* and 10*a*, respectively. The primary face 9*b* of the upper blade 9 and the secondary face 10*a* of the lower blade 10 are directed frontward and the secondary face 9*a* of the upper blade 9 and the primary face 10*b* of the lower blade 10 are directed rearward. More specifically, the primary face 9*b* of the upper blade 9 and the primary face 10*b* of the lower blade 10 are substantially aligned with each other along a plane 19 perpendicular to the sheet-shaped material 5, and the secondary faces 9*a* and 10*a* of the upper and lower blades 9 and 10 are directed in the opposite directions from each other. Contact of the upper blade 9 with the superfluous amount of resin 2*a* adhering, as shown in FIGS. 7 and 8, on the sheet-shaped material 5 as the semi-finished product causes an excessively large stress to occur on the sheet-shaped material 5. Arrangement in which the primary face 9*b* and the secondary face 9*a* of the upper blade 9 are directed to the opposite directions to those of the primary face 10*b* and the secondary face 10*a* of the lower blade 10 so that the primary face 9*b* of the upper blade 9 and the primary face 10*b* of the lower blade 10 are substantially aligned with each other along the above-mentioned plane 19 in accordance with the embodiment of the present invention, making it possible to reduce the stress applied on the sheet-shaped material 5. It is therefore possible to prevent cracks from occurring on the product 5*b* side of the sheet-shaped material 5.

Figure 5A:
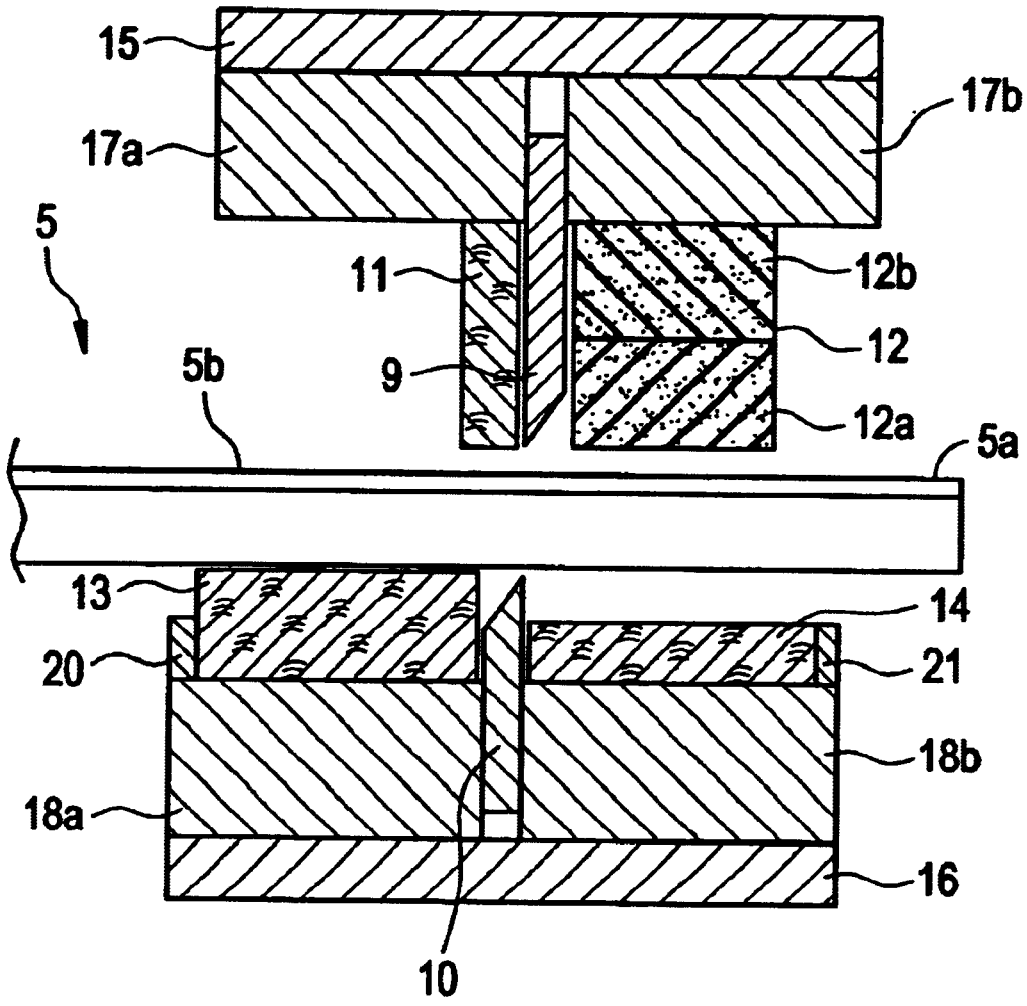
FIGS. 5(A), 5(B) and 5(C) are descriptive view of a cutting process of the sheet-shaped material, having a viewing direction based on the III—III line in FIG. 1.
Figure 5B:
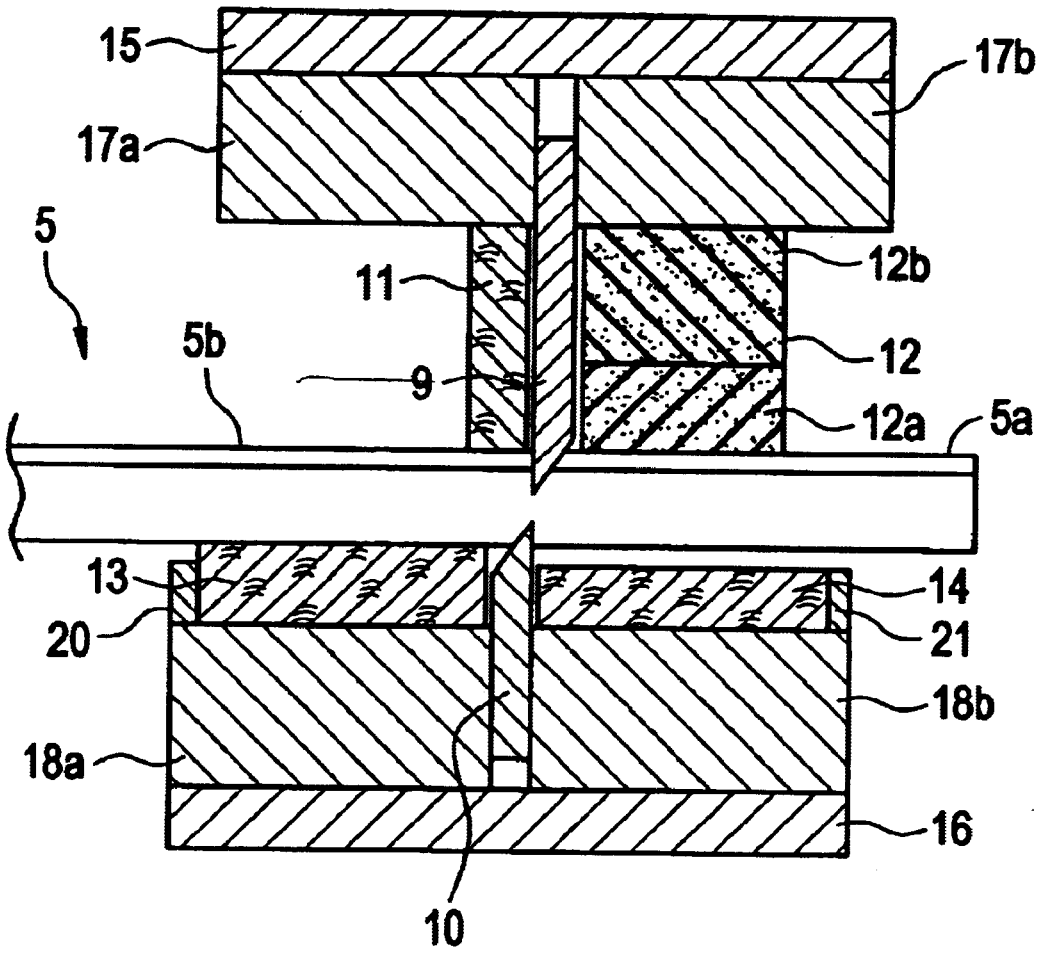
Figure 6A:
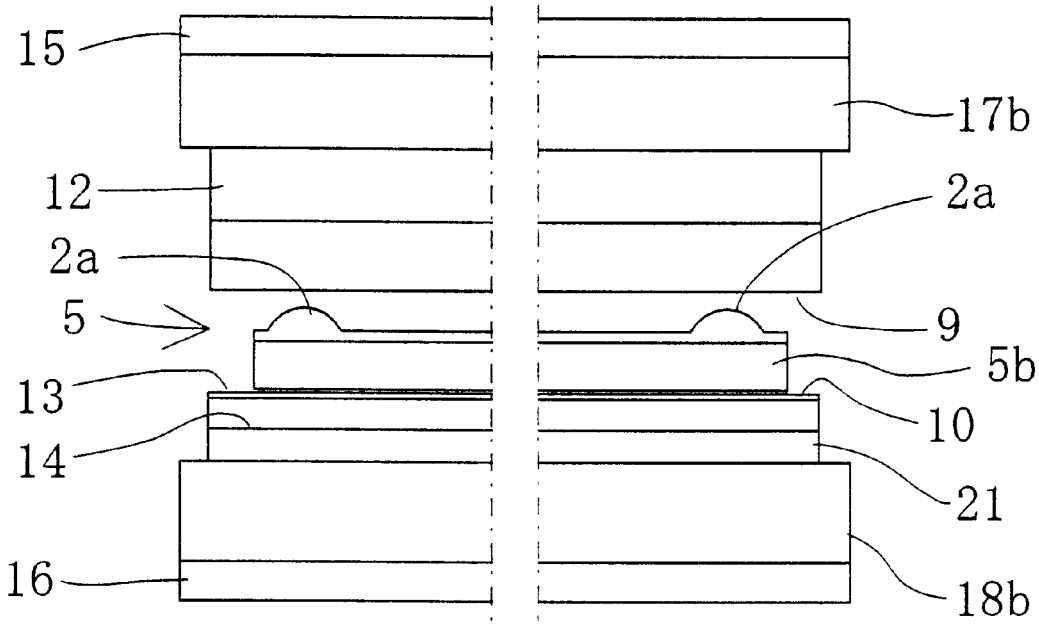
FIGS. 6(A), 6(B) and 6(C) are descriptive view of the cutting process of the sheet-shaped material, having a viewing direction based on the IV—IV line in FIG. 1.
Figure 6B:
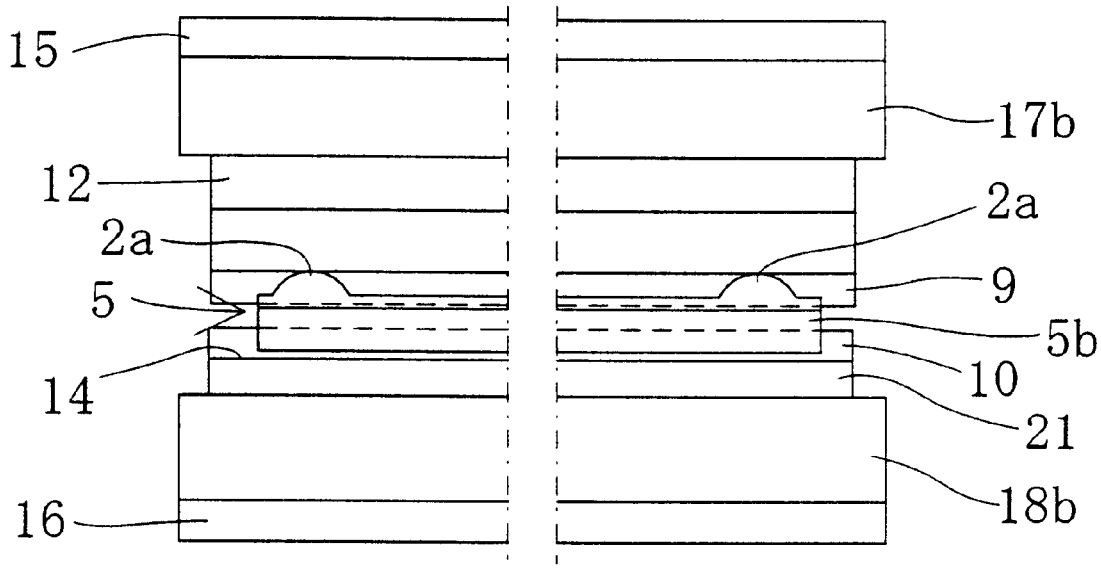

There is made a specific arrangement in which the blade edges of the upper blade 9 and the lower blade 10 do not come into contact with each other in the vertical direction so as to provide an appropriate gap between these blade edges even when the upper blade 9 moves to the closest position to the lower blade 10, as shown in FIGS. 5(B) and 6(B). Such a specific arrangement makes it possible to form notches on the opposite surfaces of the sheet-shaped material 5 by means of the upper and lower blades 9 and 10 during the first half of the single cutting process and then break the portion of the sheet-shaped material 5, which corresponds to the above-mentioned appropriate gap between the blade edges, during the second half thereof. It is therefore possible to accurately cut the sheet-shaped material 5 without causing cracks even when the sheet-shaped material 5 includes the substrate sheet 3 formed of hard material.

The holding members 11 and 12 are disposed on the opposite sides of the upper blade 9 as shown in FIGS. 3 and 4, in addition to the holding members 13 and 14 disposed on the opposite sides of the lower blade 10. When the notches are formed on the opposite surfaces of the sheet-shaped material 5 by the upper and lower blades 9 and 10, the sheet-shaped material 5 is held from the opposite surfaces by means of the holding members 11, 12, 13 and 14. The elastic deformation of the holding members 11, 12, 13 and 14 permits the blade edges of the upper and lower blades 9 and 10 into the sheet-shaped material 5. As a result, it is possible to prevent cracks from occurring on the finished product 5*b* side, and burrs from occurring on the cutting surface.

Of the second holding members 13 and 14 placed on the side of the lower blade 10, the front-side lower holding member 13, i.e., the lower holding member to be brought into contact with the finished product 5*b* side of the sheet-shaped material 5 has a height in a non-deformed state so that the upper surface of the front-side lower holding member 13 is placed slightly above the blade edge of the lower blade 10. Such a deviation of the upper surface of the front-side lower holding member 13 from the blade edge of the lower blade 10 permits the adjustment of the depth of the notch when cutting the sheet-shaped material 5 with the use of the upper and lower blades 9 and 10. Of the second holding members 13 and 14 placed on the side of the lower blade 10, the rear-side holding member 14, i.e., the lower holding member to be brought into contact with the useless end portion 5*a* side of the sheet-shaped material 5 has a height in a non-deformed state, which is smaller than the height of the front-side lower holding member 13 so that the upper surface of the rear-side lower holding member 14 is placed slightly below the blade edge of the lower blade 10. Such a specific arrangement causes force applied on the useless end portion 5*a* side from below to decrease in comparison with force applied on the finished product 5*b* side from below, leading to a smooth shearing action by means of the upper and lower blades 9 and 10. The entire holding force by which the sheet-shaped material 5 is held during the cutting operation, is reduced, thus making it possible to prevent the sheet-shaped material 5 from whitening. The front and rear-side lower holding members 13 and 14, which are formed of material having an excellent cushioning property, such as cork, rubber or the like, are adhered on the lower clamping members 18*a* and 18*b*.

The first holding members 11 and 12 placed on the opposite sides, i.e., the front and rear sides of the upper blade 9, have substantially the same height so that the lower surfaces of the holding members 11 and 12 are substantially identical in level with the blade edge of the upper blade 9. The front-side upper holding member 11, i.e., the upper holding member to be brought into contact with the finished product 5*b* side of the sheet-shaped material 5 is disposed so as to face the portion of the lower blade 10, which extends from the blade edge of the lower blade 10 to the secondary face thereof. The front-side upper holding member 11, which is formed of material having an excellent cushioning property, such as cork, rubber or the like, is adhered on the upper clamping member 17*a*. The rear-side upper holding member 12, i.e., the upper holding member to be brought into contact with the useless end portion 5*a* of the sheet-shaped material 5 has a laminate structure having the lower layer 12*a* and the upper layer 12*b*. The lower layer 12*a* is formed of material having higher hardness than the upper layer 12*b*. The higher hardness of the lower layer 12*a*, which provides the holding member 12 with the lower surface having a higher hardness, enhances the shearing action with the use of the upper and lower blades 9 and 10, in cooperation with the feature that the rear-side lower holding member 14, which face the rear-side upper holding member 12 in the vertical direction, has a relatively small height. More specifically, the rear-side upper holding member 12 has a two-layer structure provided with the lower layer 12*a*, which is formed of a plate of metal such as aluminum or the like and brought into contact with the useless end portion 5*a* of the sheet-shaped material 5, and with the upper layer 12*b*, which is formed of material having an excellent cushioning property such as neoprene in the form of sponge or the like to support the above-mentioned metallic plate on the upper base member 15.

The front-side lower holding member 13 and the rear-side lower holding member 14 are kept in their appropriate positions by means of displacement prevention members 20 and 21 abutting on the holding members 13 and 14, respectively, so as to prevent the holding members 13 and 14 from being displaced in the traveling direction of the sheet-shaped material 5, even when they come into contact with the sheet-shaped material 5 during the cutting process. The displacement prevention members 20 and 21, which are secured on the lower clamping members 18*a* and 18*b*, respectively, have a frame-shape so as to surround the holding members 13 and 14, respectively. Prevention of displacement of the holding members 13 and 14 in the traveling direction of the sheet-shaped material 5 during the cutting process results in prevention of occurrence of cracks on the finished product 5*b* side. The similar displacement prevention members to the members 20 and 21 may also be disposed for the upper holding members 11 and 12, which are placed on the opposite sides of the upper blade 9.

The supply unit 8 for supplying the sheet-shaped material 5 has two sheet-placing tables 22 and 23, two robots and sheet-guide plates 24, 25 and 26, as shown in FIGS. 1 and 2. The two sheet placing tables 22 and 23 are disposed on the opposite sides at the front side of the sheet cutting apparatus. The robots are disposed between the sheet placing tables 22, 23 and the cutting unit 7 in a similar manner as the sheet placing tables 22 and 23. The sheet guide plates 24, 25 and 26 are disposed so as to abut on the cutting unit 7.

The sheet placing tables 22 and 23 are horizontal plates, which are mounted on the frames 27 and 28, respectively. The sheet placing tables 22 and 23 have rectangular recesses 22*a* and 23*a*. Suction cups 29 and 30 are disposed along the recesses 22*a* and 23a, respectively, so as to be directed upward. The sheet-placing table 22 is slidably mounted on a pair of guide rails 31, which are fixed horizontally on the frame 27 so as to extend longitudinally. The other sheet-placing table 23 is also slidably mounted on a pair of guide rails 32, which are fixed horizontally on the frame 28 so as to extend longitudinally. The sheet placing tables 22 and 23 are slidable in a reciprocating manner from the respective first positions as shown in solid lines in FIG. 1 to the respective second positions one of which is only shown in two-dot chain lines in the same figure along the guide rails 31 and 32 by the driving of air cylinders 33 and 34 connected to the frames 27 and 28, respectively. Holding plates 35 and 36 for holding the sheet-shaped material 5 from below are placed in the recesses 22*a* and 23*a* of the sheet placing tables 22 and 23, respectively. The holding plates 35 and 36 are movable in the vertical direction between the respective first positions at which the sheet placing tables 22 and 23 are flush with the upper surfaces of the sheet placing tables 22 and 23, that define the recesses 22*a* and 23*a* and the respective second positions, which are placed below the above-mentioned first positions, by the driving of the other air cylinders 37 and 38. The operation of the sheet placing tables 22 and 23 will be described below. When the sheet-shaped materials 5 as the semi-finished product shown in FIGS. 7(C) and 8(A) are put on the sheet placing tables 22 and 23, which are in a stand-by condition in the positions shown in solid lines by an operator or the other device, the suction cups 29 and 30 provided at the periphery of the recesses 22*a* and 23*a* suck the sheet-shaped materials 5 to hold them stationary on the sheet placing tables 22 and 23. At this time, the holding plates 35 and 36 have already ascended in the recesses 22*a* and 23*a* to hold the sheet-shaped materials 5 and 5 from below so as to prevent them from sagging down until the suction cups 29 and 30 suck the sheet-shaped materials 5. After the suction cups 29 and 30 suck the sheet-shaped materials 5, the holding plates 35 and 36 descend in the recesses 22*a* and 23*a*. Then, the sheet placing tables 22 and 23, which hold the sheet-shaped materials 5, move on the guide rails 31 and 32 to the respective second positions one of which is only shown in the two-dot chain lines. The sheet-shaped materials 5 placed on the sheet placing tables 22 and 23 are passed to the subsequent robots in the respective second positions, which are only shown in the two-dot chain lines, and then, the sheet placing tables 22 and 23 return to the respective first original positions. The operations described above for the two sheet placing tables 22 and 23 are repeated.

The robots may be for example sequence robots controlled by a sequential control. A programmable controller or the like may be used as the sequential control device. Robot bodies 37 and 47, which are disposed on the sheet placing tables 22 and 23, respectively, are alternately and reciprocally movable along a rail 40 as shown in the one-dot chain lines in FIG. 1 from the rear side of the sheet placing tables 22 and 23 to the front side of the cutting unit 7. The above-mentioned rail 40 branches off into two parallel directions. The robots have hands 41 and 42, respectively. The hands 41 and 42 match with the recesses 22*a* and 23*a* of the sheet placing tables 22 and 23, which move to reach the second positions, one of which is only shown in the two-dot chain lines. The hands 41 and 42 are provided on their upper surfaces with a plurality of suction cups 43 and 44 for sucking the sheet-shaped material 5. The suction cups 43 and 44 stand upward.

Operation of the robots will be described below. First, the hand 41 of the left-hand robot body 39, which stands by in the first position as shown in the solid lines, enters the recess 22*a* of the left-hand sheet placing table 22, which has moved to reach the second position as shown in the two-dot chain lines, to receive the sheet-shaped material 5. The suction cups 43 suck the sheet-shaped material 5 thus received. Suction of the sheet-shaped material by means of the suction cups 29 of the sheet placing table 22 is simultaneously released. The robot body 39 moves in front of the cutting unit 7 on the rail 40 and then stops moving. Then, the hand 41 puts the sheet-shaped material 5 supported between the upper and lower blades 9 and 10. The upper blade 9 descends to cut a side of the sheet-shaped material 5, i.e., the useless end portion 5*a* off from the sheet-shaped material 5 in cooperation with the lower blade 10.

The cutting operations of the useless end portions 5*a* are carried out along the cutting lines CL1, CL2, CL3 and CL4 as shown in FIG. 8(A) in this order. More specifically, the useless end portion 5*a* is cut first along the cutting line CL1. The place of the useless end portion 5*a* corresponds to the front end of the sheet-shaped material 5, which passes between the nip rollers 4 as shown in FIG. 7(B). A large amount of superfluous resin 2*a* adheres on a front end of the sheet-shaped material 5.

After completion of the cutting operation of the useless end portion 5*a* along the cutting line CL1, the robot body 39 goes back to a turning area 40*a* on the rail 40. Then, the hand 41 is turned by 180 degrees and the robot body 39 advances to the side of the cutting unit 7 again. Here, another useless end portion 5*a* is cut along the cutting line CL2 by means of the upper and lower blades 9 and 10 of the cutting unit 7. The useless end portion 5*a* cut thus has the largest amount of superfluous resin 2*a*.

Then, the robot body 39 goes back again to the turning area 40*a* on the rail 40. The hand 41 is then turned by 90 degrees and the robot body 39 advances to the side of the cutting unit 7 again. Here, another useless end portion 5*a* is cut along the cutting line CL 3 by means of the upper and lower blades 9 and 10 of the cutting unit 7.

Then, the robot body 39 goes back again to the turning area 40*a* on the rail 40. The hand 41 is then turned by 180 degrees and the robot body 39 advances to the side of the cutting unit 7 again. Here, still another useless end portion 5*a* is cut along the cutting line CL 4 by means of the upper and lower blades 9 and 10 of the cutting unit 7.

An amount of superfluous resin 2*a* adhering on each of the useless end portions 5*a* cut along the cutting lines 3 and 4 is smaller than that of the useless end portions 5*a* cut along the cutting lines 1 and 2. When a pair of opposing sides, i.e., the useless end portions 5*a* having a large amount of superfluous resin 2*a* are cut off first along the cutting lines CL 1 and 2 in this order, and then the remaining pair of opposing sides, i.e., the useless end portions 5*a* having a small amount of superfluous resin 2*a* are cut off along the cutting lines CL 3 and 4 in this order, the amount of superfluous resin 2*a* adhering on the useless end portion to be cut along the cutting line CL 3 or 4 has a small influence on the cutting efficiency in comparison with the case where the cutting operation is carried out along the cutting lines CL 3, 4, 1 and 2 in this order. Accordingly, a smooth cutting operation is ensured, thus appropriately preventing cracks from occurring.

Figure 8A:
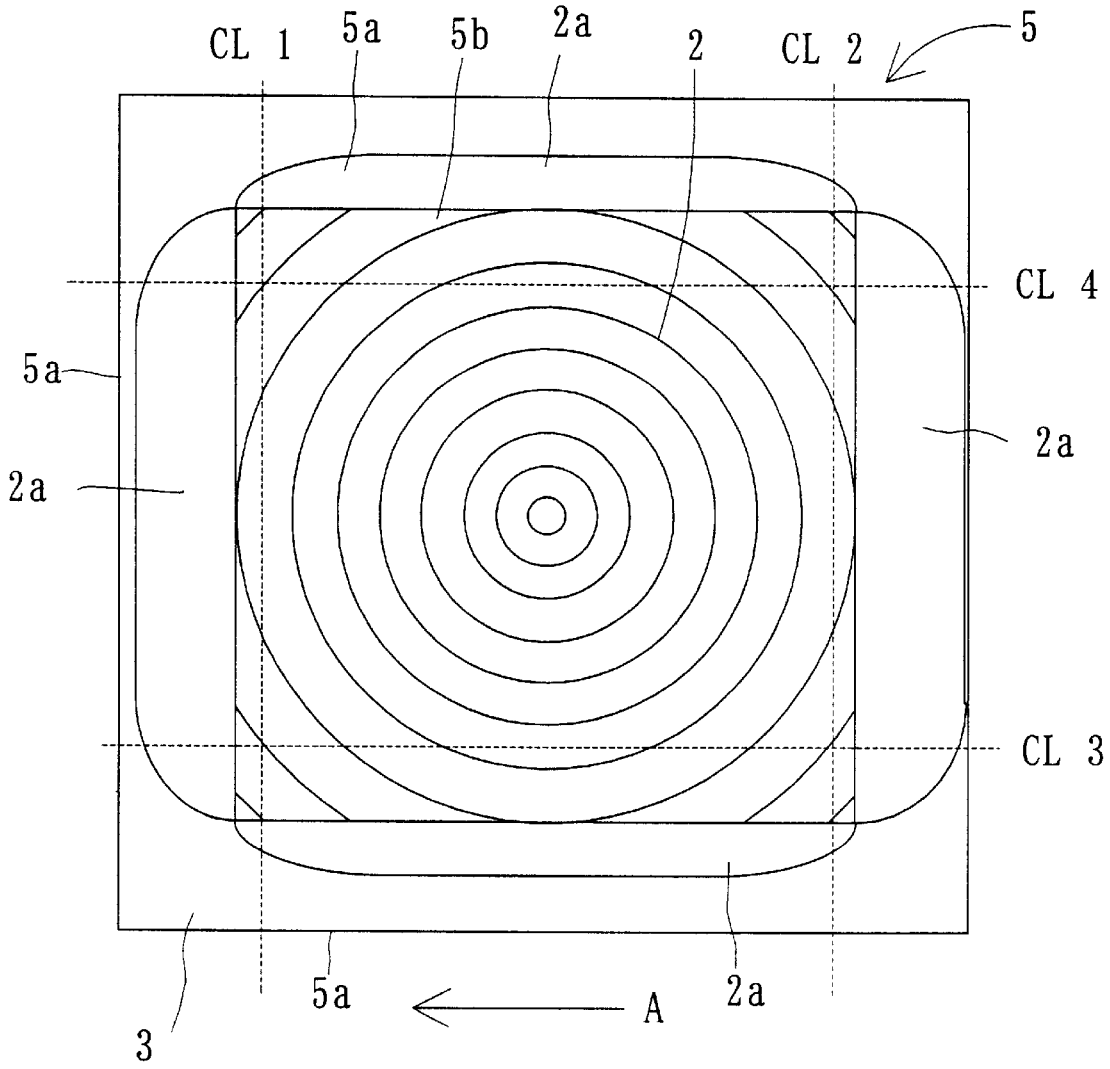
FIG. 8(A) PRIOR ART
FIG. 8(A) is a plan view illustrating the sheet-shaped material as the semi-finished product and FIG. 8(B) is a plan view illustrating the sheet-shaped material as the finished product.
Figure 8B:
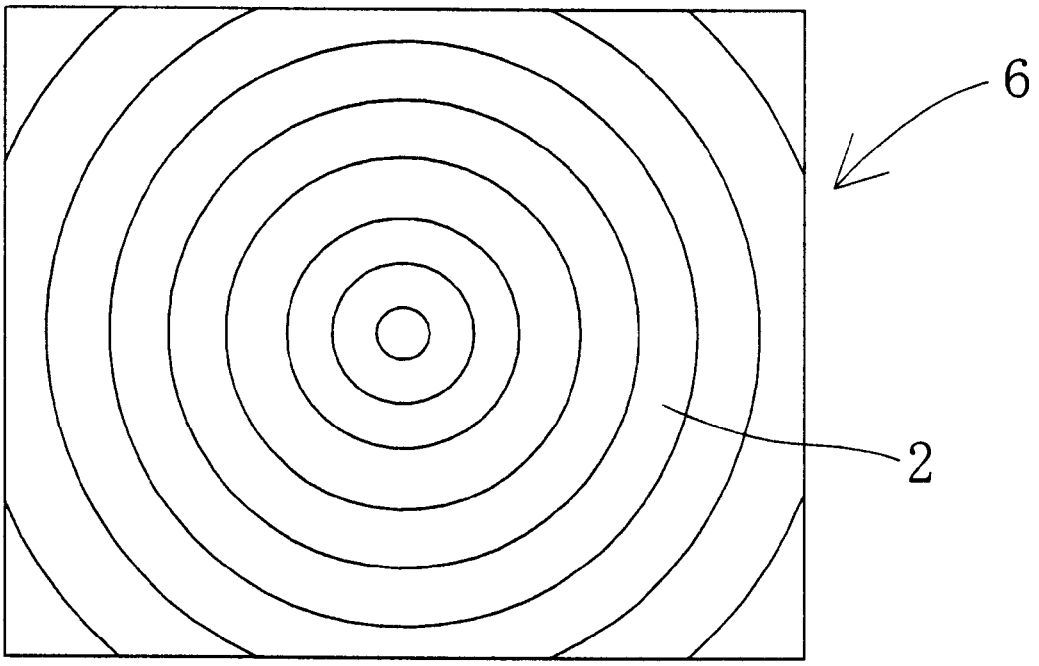
FIG. 8(B) PRIOR ART

As a result, there is obtained a sheet-shaped material 6 as the finished product as shown in FIG. 8(B). The robot body 39 returns to the original position, while maintaining the state that the suction cups 43 of the hand 41 suck the sheet-shaped material 6 as the finished product. Then, the sheet-placing table 22, which stands by in the second position as shown in the two-dot chain lines, receives the sheet-shaped material 6 thus obtained. The sheet-placing table 22 then returns to the first position as shown in the solid lines. The operator takes the sheet-shaped material 6 from the sheet-placing table 22 and then places a new sheet-shaped material 5 as the semi-finished product on the sheet-placing table 22.

A new sheet-shaped material 5 is supplied from the right-hand sheet-placing table 23 to the hand 42 of the robot body 47, during operation of the left-hand robot body 39. The right-hand robot body 47 stands by in a right-hand stand-by area 40*b* on the rail 40, while holding the sheet-shaped material 5. The right-hand robot body 47 moves to the cutting unit 7, after the left-hand robot body 39 has left the cutting unit 7 and then passed through the turning area 40*a* toward a left-hand stand-by area 40*b*.

The sheet-guide plates 24, 25 and 26 are provided horizontally along the traveling route of the robot bodies 39 and 47, i.e., the rail 40. The sheet-shaped material 5 tends to project from the periphery of the hand 41 or 42 of the robot to sag down. The sheet-guide plates 24, 25 and 26 however prevent the sheet-shaped material 5 from sagging down to keep the entirety of the sheet-shaped material 5 substantially in a flat state. Such a structure makes it possible to travel the sheet-shaped material 5 as the semi-finished product, which is sucked by the hand 41 or 42, in substantially a flat state to the cutting unit 7, while guiding the sheet-shaped material 5 by means of the sheet-guide plates 24, 25 and 26. It is also possible to discharge the sheet-shaped material 6 as the finished product onto the sheet placing table 22 or 23 in substantially a flat state, while guiding the sheet-shaped material 6 by means of the sheet-guide plates 24, 25 and 26.

The supply unit 8 for the sheet-shaped material 5 supplies alternately the sheet-shaped materials 5 from the two supply sources to the upper and lower blades 9 and 10, so as to reduce the period of time required to supply the sheet-shaped materials 5 to the upper and lower blades 9 and 10 in comparison with the case where the single sheet-shaped material is supplied from the single supply source to the cutting unit, thus improving the cutting efficiency.

Figure 7A:
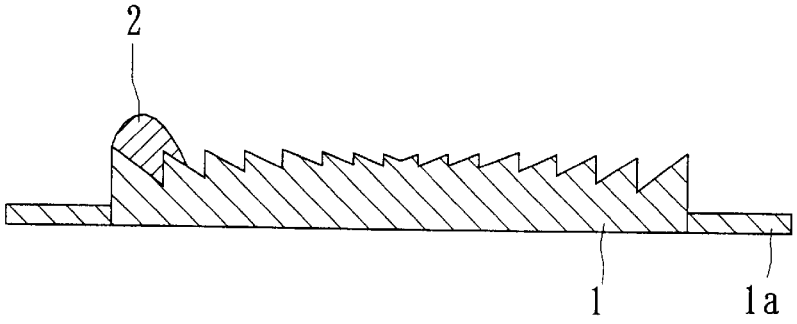
FIG. 7(A) PRIOR ART
FIGS. 7(A), 7(B) and 7(C) are cross-sectional views illustrating a process for forming the sheet-shaped material, and more specifically.
Figure 7B:
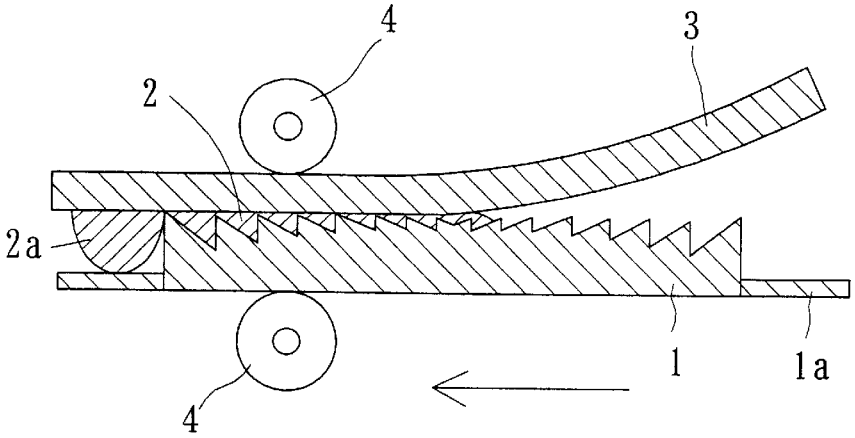
FIG. 7(B) PRIOR ART
Figure 7C:
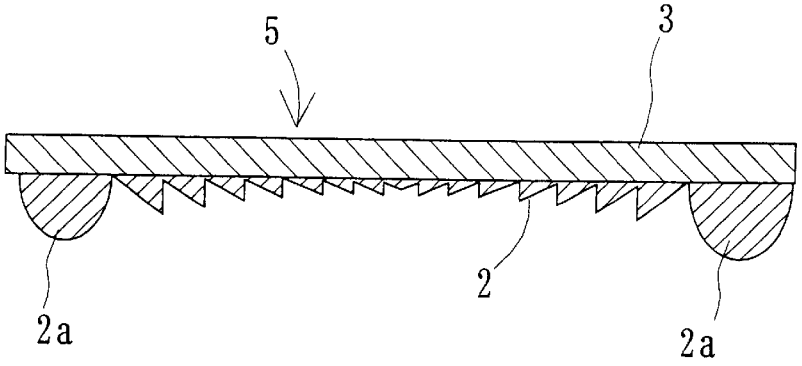
FIG. 7(C) PRIOR ART

In the process for forming the sheet-shaped material 5 as shown in FIGS. 7(A), 7(B) and 7(C), a metallic mold serving as the forming die 1 is previously heated in order to improve fluidity of the ultraviolet ray curing type resin 2 on the forming die 1. As a result, the sheet-shaped material 5 as the semi-finished product removed from the forming die has a higher temperature than a room temperature. A cutting operation, which is carried out by means of the cutting apparatus after the lapse of time during which the temperature of the sheet-shaped material 5 as the semi-finished product decreases to room temperature, makes it possible to obtain a finished product having a standardized size. Such a cutting operation leads to a low manufacturing efficiency. The cutting operation, which is carried out in a state in which the sheet-shaped material 5 as the semi-finished product has a higher temperature than room temperature, accompanies shrinkage of the sheet-shaped material 6 as the finished product, thus making it impossible to provide any finished product having a standardized size. In view of these circumstances, the cutting apparatus of the present invention for cutting the sheet-shaped material 5 is provided with the device described below so that the cutting operation can be carried out in a state that the sheet-shaped material 5 as the semi-finished product 5 has a higher temperature than room temperature, in anticipation of shrinkage of the sheet-shaped material 5.

More specifically, there are provided temperature sensors 45 and 46 for detecting temperature of the sheet-shaped material 5 supplied into the cutting apparatus and with a computing unit for calculating the extent of expansion of the sheet-shaped material 5 on the basis of the signals from the temperature sensors 45 and 46. The temperature sensors 45 and 46, which are for example an infrared radiation thermometer, are mounted on the upper side of the supply unit 8 for supplying the sheet-shaped material 5 as shown in FIGS. 1 and 2. The computing unit, which is provided in a control device of the above-described robot, calculates the amount of elongation ΔL in accordance with the following formula to output the same:

$$\Delta L = L\alpha(t - t_o)$$

wherein, "α" is coefficient of linear expansion of the sheet-shaped material 5, "t" is a temperature of the sheet-shaped material when the cutting operation is carried out, "$t_o$" is a room temperature and "L" is a length of the sheet-shaped material 5 at a room temperature. The value of "$t-t_o$" is measurable by means of the temperature sensors 45 and 46. The value of "α" is available through an experiment or the like, which has previously been made. The value of "L" is determined on the basis of the standard of the finished product.

The calculation results according to the above-mentioned formula are reflected in the control of the robot with the use of the control device. The feeding rate of the sheet-shaped material 5 into the space between the upper and lower blades 9 and 10 is adjusted in accordance with the calculation results. The sheet-shaped materials 6 as the finished product, which have been cut by means of the cutting apparatus of the present invention, are cooled to the room temperature to shrink, thus providing a standardized size as desired.

Now, a sequential operation of the above-mentioned cutting apparatus of the present invention will be described below.

Each of the sheet-shaped materials 5 as the semi-finished product shown in FIG. 7(C) and FIG. 8(A), which have been manufactured in accordance with the processes as shown in FIGS. 7(A), 7(B) and 7(C), is placed on each of the holding plates 35 and 36, which are placed in the recesses 22*a* and 23*a* of the supply unit 8 as shown in FIG. 1, respectively, in a state that the sheet-shaped materials 5 have a higher temperature than room temperature or are cooled to room temperature.

The sheet placing tables 22 and 23 stationarily hold the sheet-shaped materials 5 with the use of the suction cups 29 and 30. Then, the holding plates 35 and 36 descend below the sheet placing tables 22 and 23. The sheet placing tables 22 and 23 move from the respective first positions as shown in the solid lines to the respective second position, one of which is shown in the two-dot chain lines, while holding the sheet-shaped materials 5. The hands 41 and 42 of the robots enter the recesses 22*a* and 22b of the sheet placing tables 22 and 23, respectively.

The hands 41 and 42 of the robots receive the sheet-shaped materials 5 from the sheet placing tables 22 and 23, respectively, and then, the robot bodies 39 and 47 move to the cutting unit 7 on the rail 40. The robot body 39 or 47 moves reciprocally between the turning area 40*a* and a cutting area 40*c*, which is in the vicinity of the cutting unit 7, to put the respective sides of the sheet-shaped material 5, which has been held by means of the hand 41 or 42, into the space between the upper and lower blades 9 and 10.

In the case where the sheet-shaped material 5 is cooled to room temperature, the feeding rate of the sheet-shaped material 5 is calculated on the basis of the standardized size of the finished product. In the case where the sheet-shaped material 5 has a higher temperature than room temperature, the sheet-shaped material 5 is supplied at a relatively small feeding rate in anticipation of an amount of shrinkage calculated by the computing unit on the basis of the temperature sensors 45 and 46.

The robot body 39 or 47 first reaches the cutting area 40*c*, and the sheet-shaped material 5 is cut along the cutting line CL 1 as shown in FIG. 8(A).

The cutting process will be described below on the basis of FIGS. 5 and 6. The sheet-shaped material 5 is placed so that its product 5*a* side rests on the front-side lower holding member 13 for the lower blade 10 (see FIGS. 3, 4, 5(A) and 6(A)). The upper blade 9 descends together with the upper clamping members 17*a* and 17*b* and the upper base member 15. The sheet-shaped material 5 is stationarily held from the opposite surfaces by means of the holding members 11, 12, 13 and 14. A deep notch is then formed by means of the upper and lower blades 9 and 10 (see FIGS. 5(B) and 6(B)). The upper holding member 12, which is disposed on the rear side of the upper blade 9 and has the lower layer 12*a* formed of hard material, making it possible to strongly urge the sheet-shaped material 5 against the lower blade 10, irrespective of the existence of the portion of the superfluous resin 2*a* cured. In addition, the front-side lower holding member 13 for the lower blade 10 has a height in a non-deformed state so that the upper surface of the front-side lower holding member 13 is placed slightly above the blade edge of the lower blade 10. Such a deviation of the upper surface of the front-side lower holding member 13 from the blade edge of the lower blade 10 permits the upper blade 9 to come into contact with the sheet-shaped material 5 prior to contact of the lower blade 10 with the sheet-shaped material 5, thus adjusting the depth of the notch when cutting the sheet-shaped material 5 with the use of the upper and lower blades 9 and 10.

Figure 5C:
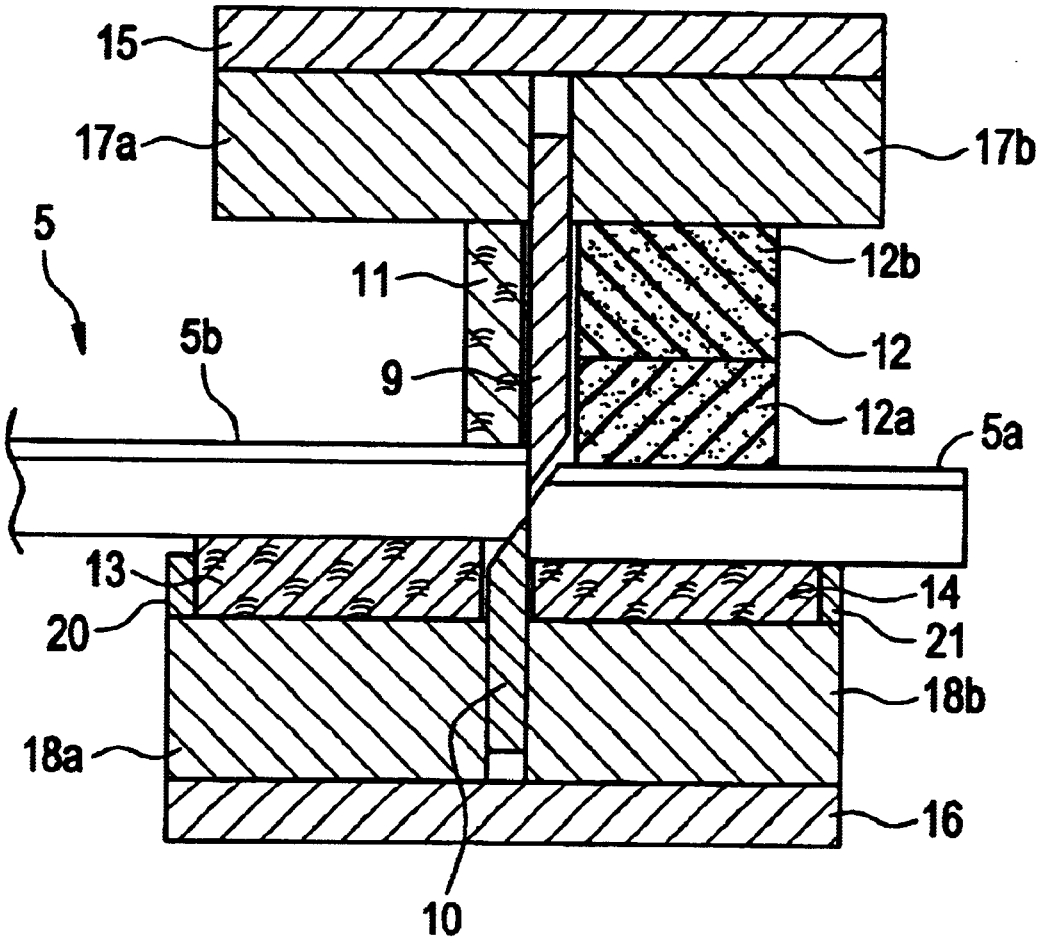
Figure 6C:
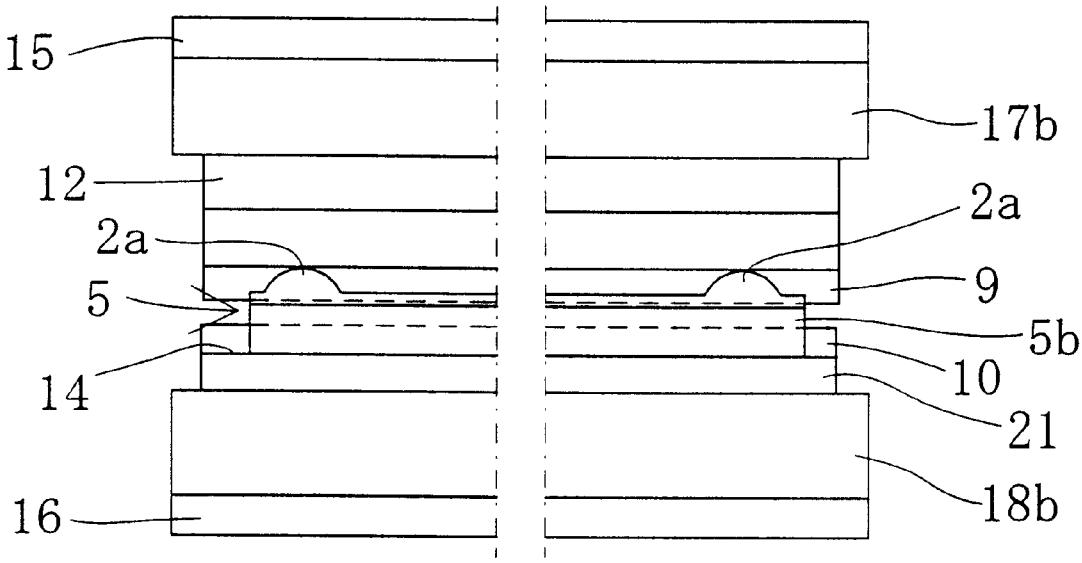

The upper blade 9 stops in a prescribed position so as not to come into contact with the lower blade 10 (see FIGS. 5(C) and 6(C)), and the portion of the sheet-shaped material 5, which corresponds to the gap between the blade edges of the upper and lower blade 9 and 10 that have been put in the closest position, is broken without the cutting action of the upper and lower blades 9 and 10.

After completion of the cutting operation of the sheet-shaped material 5 along the cutting line CL 1, the robot body 39 or 47 goes back to the turning area 40*a*. Then, the hand 41 or 42 is turned by 180 degrees and the robot body 39 or 47 moves again to the cutting area 40*c* to put the sheet-shaped material 5 into the gap between the upper and lower blades 9 and 10. In this state, the upper and lower blades 9 and 10 cut the sheet-shaped material 5 along the cutting line CL 2. Then, the robot body 39 or 47 goes back again to the turning area 40*a*. Then, the hand 41 or 42 is turned by 90 degrees and the robot body 39 or 47 moves again to the cutting area 40*c* to put the sheet-shaped material 5 into the gap between the upper and lower blades 9 and 10. In this state, the upper and lower blades 9 and 10 cut the sheet-shaped material 5 along the cutting line CL 3. Then, the robot body 39 or 47 goes back again to the turning area 40*a*. Then, the hand 41 or 42 is turned by 180 degrees and the robot body 39 or 47 moves again to the cutting area 40*c* to put the sheet-shaped material 5 into the gap between the upper and lower blades 9 and 10. In this state, the upper and lower blades 9 and 10 then cut the sheet-shaped material 5 along the cutting line CL 4. As a result, there is obtained the sheet-shaped material 6 as the finished product as shown in FIG. 8(B). The robot body 39 or 47 returns to the original position, while maintaining the state that the suction cups 43 of the hand 41 suck the sheet-shaped material 6 as the finished product. Then, the sheet-placing table 22 or 23, which stands by in the second position as shown in the two-dot chain lines, receives the sheet-shaped material 6 thus obtained.

The sheet-placing table 22 or 23 then returns to the first position as shown in the solid lines, while maintaining the suction condition of the sheet-shaped material 6. The operator takes the sheet-shaped material 6 from the sheet-placing table 22 or 23 and then places a new sheet-shaped material 5 as the semi-finished product on the sheet-placing table 22 or 23.

The left-hand and right-hand robot bodies 39 and 47 are controlled so as not to interfere with each other so that the cutting operation of the sheet-shaped material 5 transferred by one of the robot bodies 39 and 47 is carried out, while the other of the robot bodies 38 and 47 stands by in the stand-by area 40*b* on the rail 40. One of the robot bodies 39 and 47 moves to the turning area 40*a* and the cutting area 40*c*, after the other of the robot bodies 39 and 47 has moved the sheet-shaped material 6 as the finished product from the cutting unit 7 toward the stand-by area 40*b*.

The above-described operations are repeated to manufacture the sheet-shaped materials 6 as the finished product.

According to the present invention as described in detail, the apparatus of the present invention for cutting a sheet-shaped material, comprises: a first blade; a second blade disposed to face said first blade so that a sheet-shaped material to be cut is placed between said first blade and said second blade; first holding members disposed on opposite sides of said first blade, each of said first holding members being formed of self-deformable material so as to be elastically deformable by pressing said sheet-shaped material during the cutting operation; and second holding members disposed on opposite sides of said second blade, each of said second holding members being formed of self-deformable material so as to be elastically deformable to hold said sheet-shaped material during the cutting operation, said first holding members and said second holding members holding said sheet-shaped material by opposite surfaces thereof when cutting said sheet-shaped material by means of said first and second blades. It is therefore possible to prevent cracks from occurring on portion other than the cutting surface and burrs from occurring on the cutting surface.

In accordance with the second aspect of the present invention, there is adopted a structure in which each of said first blade and said second blade has a primary face and a secondary face, the primary face of said first blade being substantially aligned with the primary face of said second blade, and the secondary faces of said first blade and said second blade being directed to opposite directions to each other. According to such a structure it is therefore possible to prevent an excessively large stress from occurring on the sheet-shaped material even when the first and second blades come into contact with a cured portion of superfluous resin. As a result, occurrence of cracks on the finished product side can be prevented.

In accordance with the third aspect of the present invention, there is adopted a structure in which blade edges of the first and second blades do not come into contact with each other to form a gap between said blade edges when the first and second blades are in a closest proximity to each other. According to such a structure, it is possible to form notches on the opposite surfaces of the sheet-shaped material by means of the first and second blades during the first half of the single cutting process and then break the portion of the sheet-shaped material, which corresponds to the above-mentioned gap between the blade edges, during the second half thereof. It is therefore possible to easily cut the sheet-shaped material including the substrate sheet formed of hard material.

In accordance with the fourth aspect of the present invention, there is adopted a structure in which said first holding members comprise a front-side holding member, which is to be brought into contact with a finished product side of the sheet-shaped material and a rear-side holding member, which is to be brought into contact with a useless end portion side of the sheet-shaped material, said rear-side holding member having a smaller thickness than said front-side holding member in a non-deformed state. Such a structure provides a smooth shearing action by means of the first and second blades. The entire holding force by which the sheet-shaped material 5 is held during the cutting operation, is reduced, thus making it possible to prevent the sheet-shaped material from whitening.

In accordance with the fifth aspect of the present invention, there is adopted a structure in which said second holding members comprise a front-side holding member, which is brought into contact with a finished product side of the sheet-shaped material and a rear-side holding member, which is to be brought into contact with a useless end portion side of the sheet-shaped material, and said rear side holding member has a laminate structure having a lower layer and an upper layer, said lower layer being formed of a higher hardness than said upper layer. Such a structure provides a smooth shearing action by means of the first and second blades.

In accordance with the sixth aspect of the present invention, the apparatus further comprises displacement prevention members to prevent the holding members, which come into contact with the sheet-shaped material when cutting the sheet-shaped material by means of the first and second blades, from being displaced in a traveling direction of the sheet-shaped material. According to such additional features, it is possible to prevent cracks from occurring on the finished product side.

In accordance with the sixth aspect of the present invention, the apparatus further comprises a supply unit for supplying alternately the sheet-shaped materials from a plurality of supply sources to the first and second blades. According to such an additional feature, it is possible to reduce the period of time required to supply the sheet-shaped materials to the first and second blades in comparison with the case where the single sheet-shaped material is supplied from the single supply source to the cutting unit, thus improving the cutting efficiency.

The entire disclosure of Japanese Patent Application No. 2000-336543 filed on Nov. 2, 2000 including the specification, claims, drawings and summary is incorporated herein by reference in its entirety.

What is claimed is:

1. An apparatus for cutting a sheet-shaped material, comprising:

a first blade;

a second blade disposed to face said first blade so that the sheet-shaped material to be cut is placed between said first blade and said second blade;

first holding members disposed on opposite sides of said first blade, being formed of deformable material so as to be elastically deformable by pressing said sheet-shaped material during the cutting operation; and second holding members disposed on opposite sides of said second blade, respectively, each of said second holding members being formed of deformable material so as to be elastically deformable to hold said sheet-shaped material during the cutting operation, said first holding members and said second holding members holding said sheet-shaped material by opposite surfaces thereof when cutting said sheet-shaped material by means of said first and second blades.

2. The apparatus as claimed in claim 1, wherein:

each of said first blade and said second blade have a primary face and a secondary face, the primary face of said first blade being substantially aligned with the primary face of said second blade, and the secondary faces of said first blade and said second blade being directed in opposite directions to each other.

3. The apparatus as claimed in claim 1, wherein:

blade edges of the first and second blades do not come into contact with each other to form a gap between said blade edges when the first and second blades are in a closest proximity to each other.

4. The apparatus as claimed in claim 2, wherein:

blade edges of the first and second blades do not come into contact with each other to form a gap between said blade edges when the first and second blades are in closest proximity to each other.

5. The apparatus as claimed in any one of claims 1 to 4, wherein:

said second holding members comprise a front-side holding member, which is to be brought into contact with a finished product side of the sheet-shaped material and a rear-side holding member, which is to be brought into contact with a useless end portion side of the sheet-shaped material, said rear-side holding member having a smaller thickness than said front-side holding member in a non-deformed state.

6. The apparatus as claimed in any one of claims 1 to 4, wherein:

said first holding members comprise a front-side holding member, which is to be brought into contact with a finished product side of the sheet-shaped material and a rear-side holding member, which is to be brought into contact with a useless end portion side of the sheet-shaped material, and said rear side holding member has a laminate structure having a lower layer and an upper layer, said lower layer being formed of a higher hardness than said upper layer.

7. The apparatus as claimed in claim 5, wherein:

said first holding members comprise a front-side holding member, which is to be brought into contact with a finished product side of the sheet-shaped material and a rear-side holding member, which is to be brought into contact with a useless end portion side of the sheet-shaped material, and said rear side holding member has a laminate structure having a lower layer and an upper layer, said lower layer being formed of a higher hardness than said upper layer.

8. The apparatus as claimed In any one of claims 1 to 4, further comprising:

displacement prevention members for preventing the holding members, which come into contact with the sheet-shaped material when cutting the sheet-shaped material by means of the first and second blades, from being displaced in a traveling direction of the sheet-shaped material.

9. The apparatus as claimed in claim 5, further comprising:

displacement prevention members for preventing the holding members, which come into contact with the sheet-shaped material when cutting the sheet-shaped material by means of the first and second blades, from being displaced in a traveling direction of the sheet-shaped material.

10. The apparatus as claimed in claim 6, further comprising:

displacement prevention members to prevent the holding members, which come into contact with the sheet-shaped material when cutting the sheet-shaped material by means of the first and second blades, from being displaced in a traveling direction of the sheet-shaped material.

11. The apparatus as claimed in claim 7, further comprising:

displacement prevention members to prevent the holding members, which come into contact with the sheet-shaped material when cutting the sheet-shaped material by means of the first and second blades, from being displaced in a traveling direction of the sheet-shaped material.

12. The apparatus as claimed in any one of claims 1 to 4, further comprising:

a supply unit for supplying alternately the sheet-shaped materials from a plurality of supply sources to the first and second blades.

13. The apparatus as claimed in claim 5, further comprising:

a supply unit for supplying alternately the sheet-shaped materials from a plurality of supply sources to the first and second blades.

14. The apparatus as claimed in claim 6, further comprising:

a supply unit for supplying alternately the sheet-shaped materials from a plurality of supply sources to the first and second blades.

15. The apparatus as claimed in claim 7, further comprising:

a supply unit for supplying alternately the sheet-shaped materials from a plurality of supply sources to the first and second blades.

16. The apparatus as claimed in claim 8, further comprising:

a supply unit for supplying alternately the sheet-shaped materials from a plurality of supply sources to the first and second blades.

17. The apparatus as claimed in claim 9, further comprising:

a supply unit for supplying alternately the sheet-shaped materials from a plurality of supply sources to the first and second blades.

18. The apparatus as claimed in claim 10, further comprising:

a supply unit for supplying alternately the sheet-shaped materials from a plurality of supply sources to the first and second blades.

19. The apparatus as claimed in claim 11, further comprising:

a supply unit for supplying alternately the sheet-shaped materials from a plurality of supply sources to the first and second blades.

* * * * *